US008824714B2

(12) United States Patent
Presutti et al.

(10) Patent No.: US 8,824,714 B2
(45) Date of Patent: Sep. 2, 2014

(54) EARWAX FILTER, HANDING TOOL AND DISPENSER FOR SUCH FILTER

(71) Applicant: Oticon A/S, Smørum (DK)

(72) Inventors: Dennis Presutti, Smørum (DK); Jacob Holdt Hansen, Smørum (DK); Martin Lindebjerg, Smørum (DK); Michael Frydendal, Veksø (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/853,595

(22) Filed: Mar. 29, 2013

(65) Prior Publication Data

US 2013/0259280 A1 Oct. 3, 2013

Related U.S. Application Data

(60) Provisional application No. 61/618,854, filed on Apr. 2, 2012.

(30) Foreign Application Priority Data

Mar. 30, 2012 (EP) ..... 12162650

(51) Int. Cl.
*H04R 25/00* (2006.01)

(52) U.S. Cl.
USPC ..... 381/325

(58) Field of Classification Search
CPC . H04R 25/654; H04R 25/652; H04R 2460/11
See application file for complete search history.

(56) References Cited

U.S. PATENT DOCUMENTS

| | | | | |
|---|---|---|---|---|
| 6,585,075 | B1 * | 7/2003 | Gauthier | 181/135 |
| 6,795,562 | B1 | 9/2004 | Gunnersen et al. | |
| 2004/0240694 | A1 * | 12/2004 | Wolf | 381/322 |
| 2005/0018867 | A1 * | 1/2005 | Gunnersen et al. | 381/325 |
| 2005/0175203 | A1 | 8/2005 | Karamuk | |
| 2009/0147978 | A1 | 6/2009 | Sauer et al. | |
| 2010/0322452 | A1 | 12/2010 | Ladabaum et al. | |

FOREIGN PATENT DOCUMENTS

| | | | |
|---|---|---|---|
| DE | 1259951 | B | 2/1968 |
| DE | 102010013447 | A1 | 6/2011 |
| EP | 0312517 | A2 | 4/1989 |
| EP | 1215937 | A2 | 6/2002 |
| EP | 1439731 | A1 | 7/2004 |
| WO | WO 97/09864 | A1 | 3/1997 |
| WO | WO 00/03561 | A1 | 1/2000 |
| WO | WO 2008/116500 | A1 | 10/2008 |

* cited by examiner

*Primary Examiner* — Brian Ensey
*Assistant Examiner* — Norman Yu
(74) *Attorney, Agent, or Firm* — Birch, Stewart, Kolasch & Birch, LLP

(57) ABSTRACT

A transducer protection comprises a top cap, a stem extending from the top cap and having a distal end and a seal at the stem distal ends. The top cap has an outward facing and an inward facing side, the inward facing side facing the hearing aid, when in use. The stem protrudes into an opening of a hearing aid component to be protected, when in use. The stem's proximal end is connected to the top cap at the top caps inward facing side. The protection has an outward facing contour that is adapted to match an inner wall of the hearing aid component's opening so that the outer contour of the seal contacts the inner wall of the opening, when in use. Within the seal, at least one sound opening is provided that is surrounded by the seal.

19 Claims, 10 Drawing Sheets

EARWAX FILTER, HANDING TOOL AND DISPENSER FOR SUCH FILTER

Figure 1:
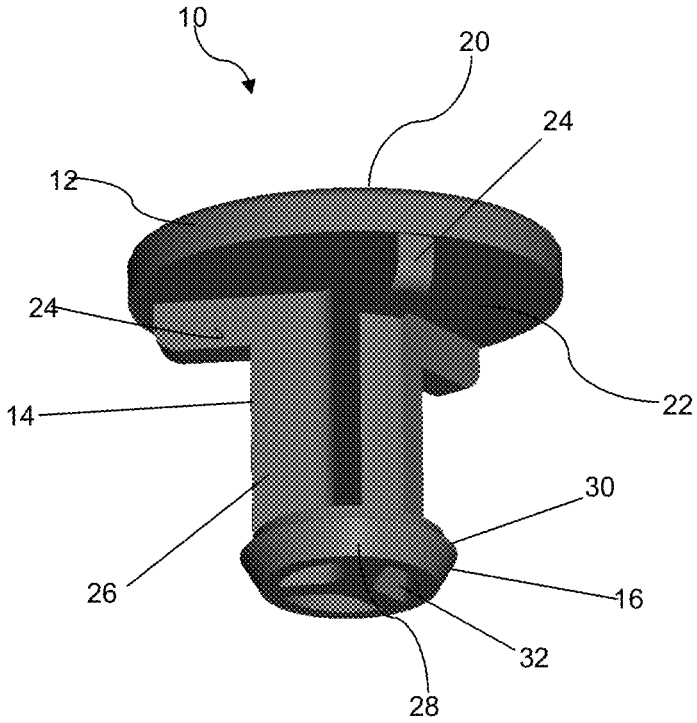

The invention relates to a transducer protection for placement in an opening of a hearing aid component. The invention further relates to a handling tool for such a transducer protection and a dispenser for a transducer protection.

Transducer protections or filters or earwax filters are used to prevent earwax or dirt from entering openings such a sound openings of a hearing aid component. Typically, transducer protections are made replaceable so that a used and potentially clogged earwax filter can be replaced by a new and clean one. To do so, handling tools are provided that help in removing a used earwax filter and in inserting a new earwax filter. To allow for easy carrying of plurality of transducer protections, transducer protection dispensers are known.

Prior art transducer protections and handing tools are inter alia disclosed in EP 1 439 731 B1 and U.S. Pat. No. 6,795,562 B1.

It is an object of the invention to provide an improved transducer protection and transducer protection handling tool. It is a further object of the invention to provide a transducer protection, which is especially suitable for a hearing aid microphone.

According to the invention, this object is achieved by a transducer protection comprising a top cap, a stem extending from the top cap and having a distal end and a seal at the stem distal end. The top cap has an outward facing and an inward facing side, the inward facing side facing the hearing aid, when in use. The stem protrudes into an opening of a hearing aid component to be protected, when in use. The stem's proximal end is connected to the top cap at the top cap's inward facing side. The seal has an outward facing contour that is adapted to match an inner wall of the hearing aid component's opening so that the outer contour of the seal contacts the inner wall of the opening, when in use. Within the seal, at least one sound opening is provided that is surrounded by the seal. The sound opening surrounded by the seal communicates with at least one sound opening along the stem. On the inward facing side of the top cap at least one spacer is provided, that is formed to provide for a gap between the inward facing side of the top cap and an outer surface of a hearing aid component, when in use. The gap that is caused by the spacer acts as sound entrance between the top cap and the hearing aid component's outer surface.

This gap, the sound opening along the stem and the sound opening surrounded by the seal are in communication with each other, when the transducer protection is placed into an opening of a hearing aid component so as to let sound pass from inside the hearing aid component to its outside or vice versa through the gap and the sound openings along the stem and surrounded by the seal. When placed in a microphone opening, the protection will cover the opening by means of the top cap, and when colored in the same shade as the hearing aid component into which it is inserted, the protection will be virtually invisible to the naked eye, and this will help to make such a hearing aid less conspicuous.

Preferably, the transducer protection is a single piece of material e. g. an injection molded plastic piece.

Furthermore, the top cap preferably has a lateral extension that is larger than a diameter of the opening of the transducer protection it is designed for. Further, the top cap preferably provides no openings so that the mouth of the opening in the hearing aid component is fully closed and covered by the top cap except for the gap between the top cap and the hearings aid component's surface that is provided by the spacer.

By such an earwax filter, an effective protection from earwax entering an opening of a hearing aid component is achieved, because a top cap effectively covers the mouth of an opening in a hearing aid component when in use. Further, an oily component of the earwax is prevented from creeping along an inner wall of an opening of a hearing aid component by way of the seal that circumferentially and tightly abuts the inner wall. When the transducer protection is lifted out of the hearing aid opening, the seal will scrape along the inside of the tube, and through this action, possible ear wax or other deposits are removed by the scraping action, which leaves the inside of the tube cleaned. This is of major importance, as the next filter to be inserted will be inserted into a clean tube, which avoids the pushing of deposits further into the hearing aid when the filter is inserted.

Preferably, the seal has a sharp peripheral edge that abuts against the inner wall of the opening of a hearing aid component when in use. The sharp peripheral edge of the seal has a cross-sectional extension that matches or is slightly larger than the cross-section of an opening for which the transducer protection is designed. This ensures contact between the edge of the seal whereby wax components are prevented from advancing along the wall and past the seal. During extraction of the filter, the edge of the seal abutting the tube will facilitate a cleaning action on the inner wall of the tube as the edge with maintained contact to the inner wall is drawn there-along to the end of the tube.

If the opening end of the tube has a uniform cross-section—at least in a portion that shall receive the transducer protection—it is preferred that the top cap of the transducer protection has a lateral extension that is larger than the lateral extension of the seal and its peripheral edge.

The top cap and the seal are spaced apart from each other in a longitudinal direction of the transducer protection. The longitudinal axis of the transducer protection extends transverse to a hearing aid component's surface, when in use.

Preferably, the stem includes at least one wall element extending along a longitudinal axis of the earwax filter. This wall delimits the sound opening along the stem at least on one side. It should be understood that with "longitudinal axis" of the earwax filter an axis is meant that extends along a longitudinal extension of an opening of a hearing aid component.

The sound opening along the stem preferably is radially open to the outside of the earwax filter, meaning that the sound opening along the stem is not enclosed by walls of the earwax filter itself. Rather, when in use, the sound opening along the stem is defined on its outside by the inner wall of the opening of the hearing aid component. Thus, capillary effects between an inner wall of an opening in a hearing aid component and peripheral walls of the transducer protection may be avoided.

By means of the stem, the seal is placed at some distance from an opening's mouth which further helps to prevent oil from creeping into the opening.

To even more effectively prevent oily substances from creeping along the earwax filter or the inner wall of an opening in a hearing aid component, it is preferred that the stem is configured to be spaced apart from an inner wall of the opening when in use. In other words, the stem has some distance from the inner wall of the opening in the radial direction. In particular, the stem is designed such that the distance is large enough to avoid any capillary effect between radially outwardly facing surfaces of the stem and the inner wall of the opening.

In a preferred embodiment, the stem is constituted by three wall elements that extend radially from a central longitudinal axis of the earwax filter in three different radial directions.

As a result, the stem has a cross-section that is star-shaped. Preferably, the walls each meet at an angle of 120° in the center of the earwax filter. Thus, three sound openings along the stem are defined by the three wall elements, each sound opening being defined by two adjacent wall elements and the inner wall of the opening in the hearing aid component.

With respect to the spacer arranged at the inwardly facing side of the top cap, it is preferred that three spacers are provided, which are rib-shaped. Each rib-shaped spacer extends in the same radial and longitudinal direction as a corresponding wall element of the stem and preferably has the same thickness as the wall element of the stem. In other words, the dimensional extension of each wall element and the spacer in the direction perpendicular to the radial direction of the earwax filter is preferably the same.

It is further preferred that a distal end face of each wall element and of the seal are arranged in the same plane that preferably extends perpendicular to the longitudinal direction of the earwax filter.

If is further preferred that the seal is supported by all three wall elements near the distal end of the earwax filter. Thus, three sound openings surrounded by the earwax filter are defined by the seal surrounding the wall elements and the sound openings.

To allow for easy insertion of the earwax filter, an outer circumferential surface of the seal is having a frusto-conical shape, so that the front edge of the seal is beveled.

The seal preferably has a generally annular shape in order to match a cylindrical-shaped opening in a hearing aid component.

Figure 2:
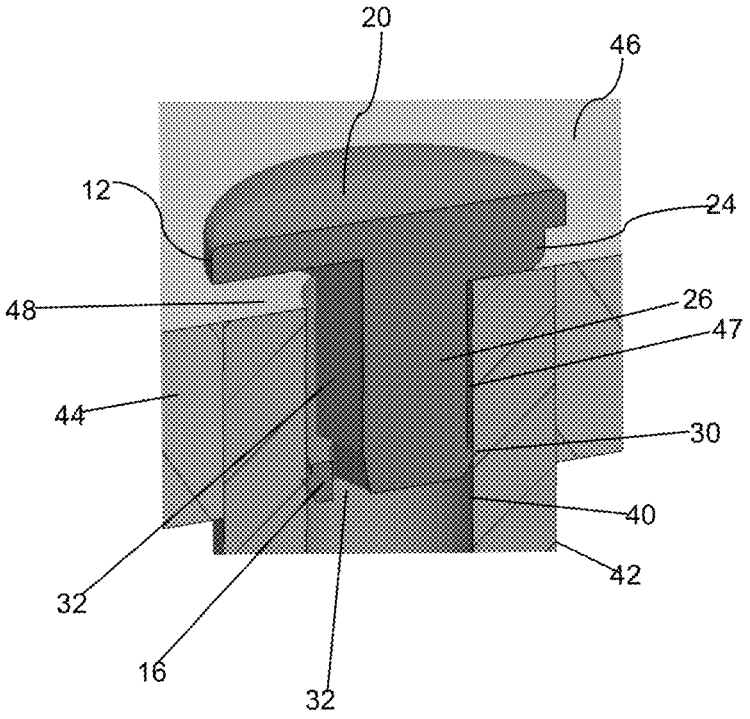
Figure 3:
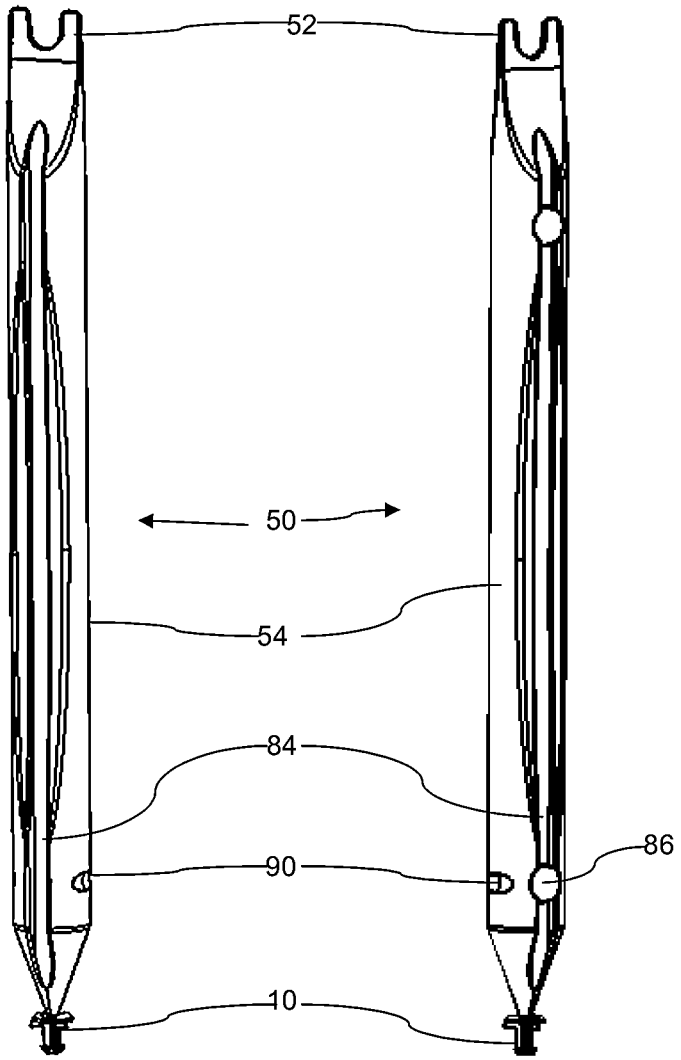
Figure 4:
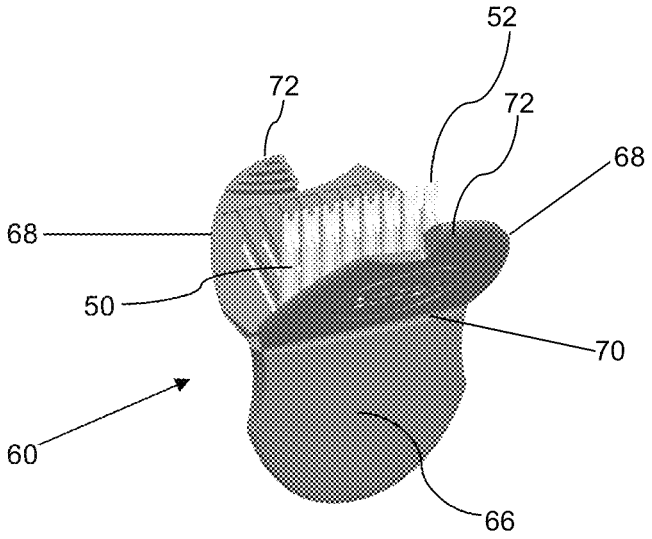
Figure 5A:
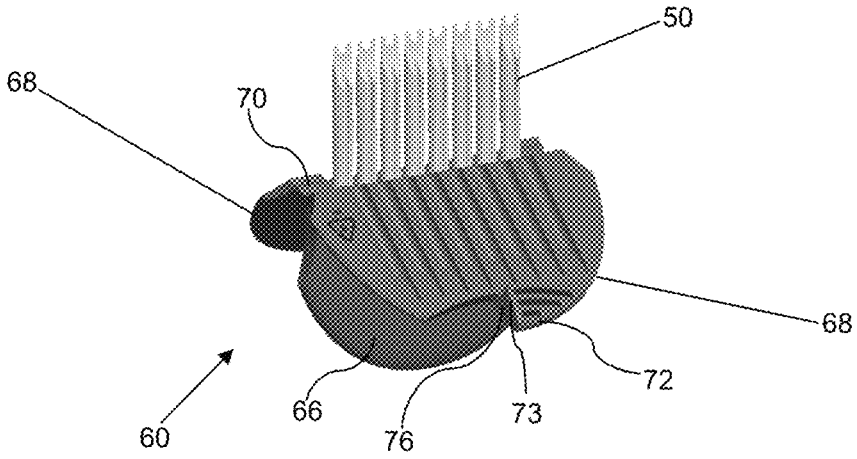
Figure 5B:
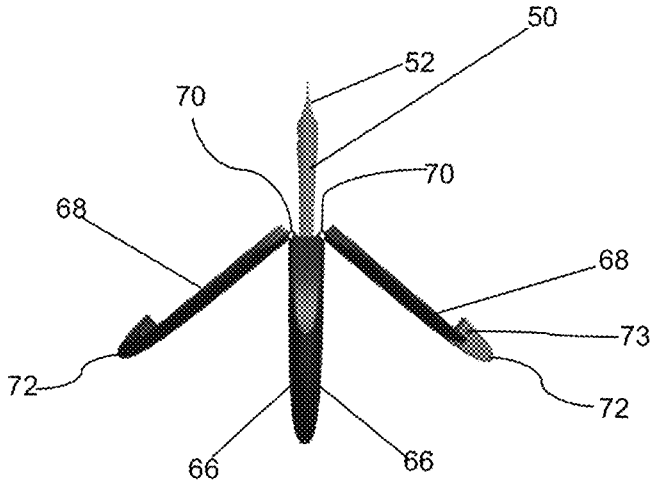
Figure 6:
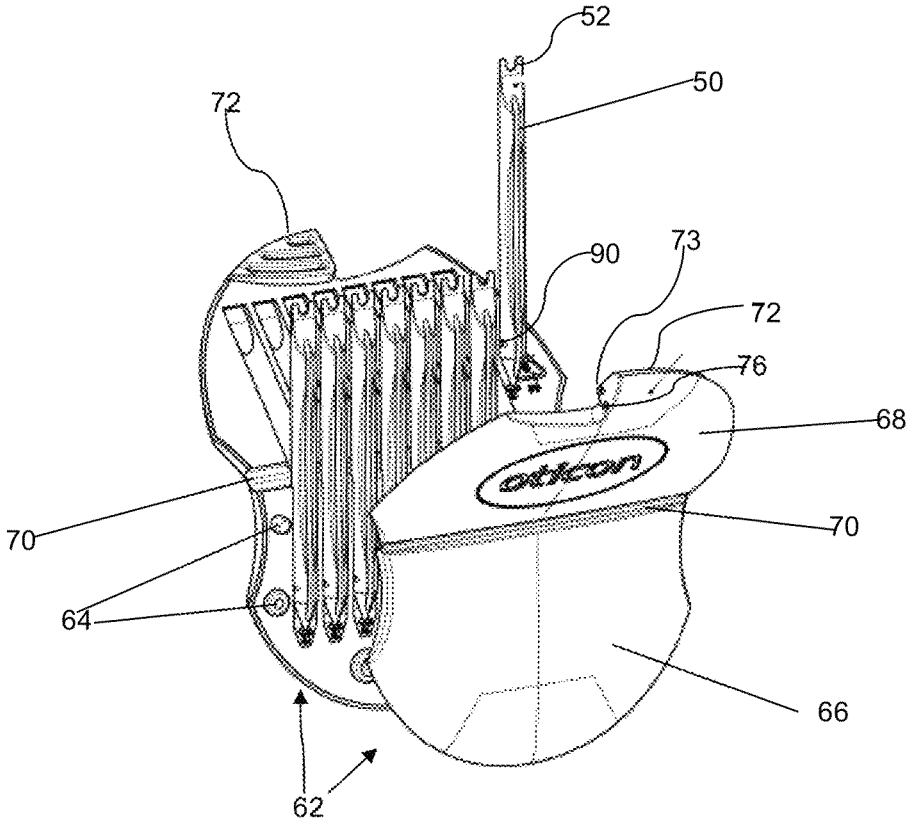
Figure 7:
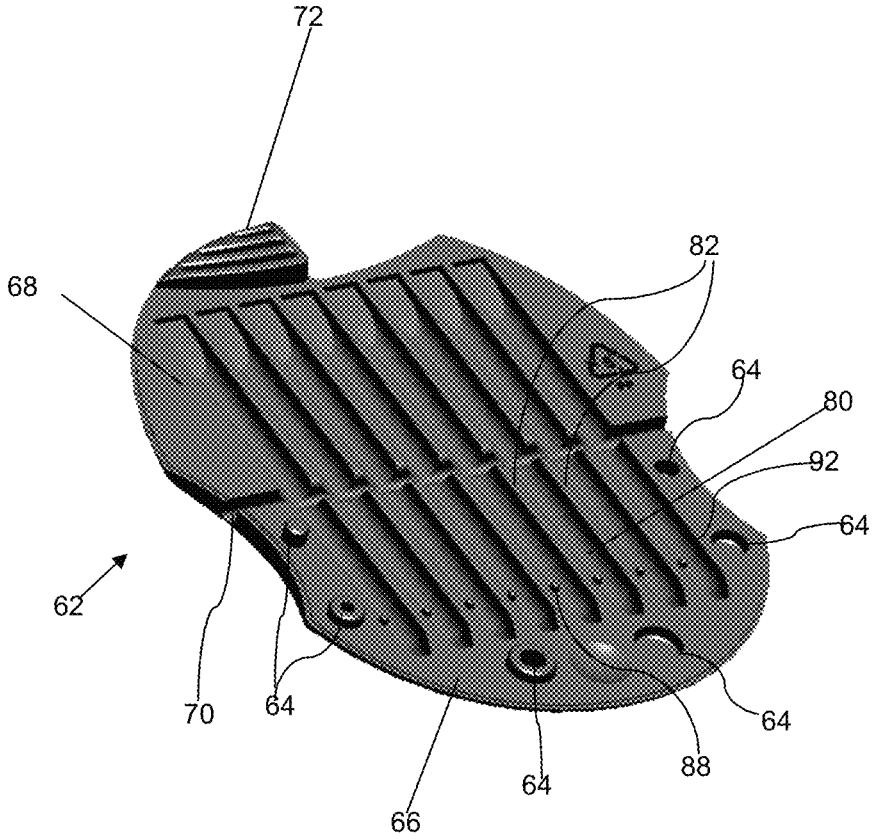
Figure 8:
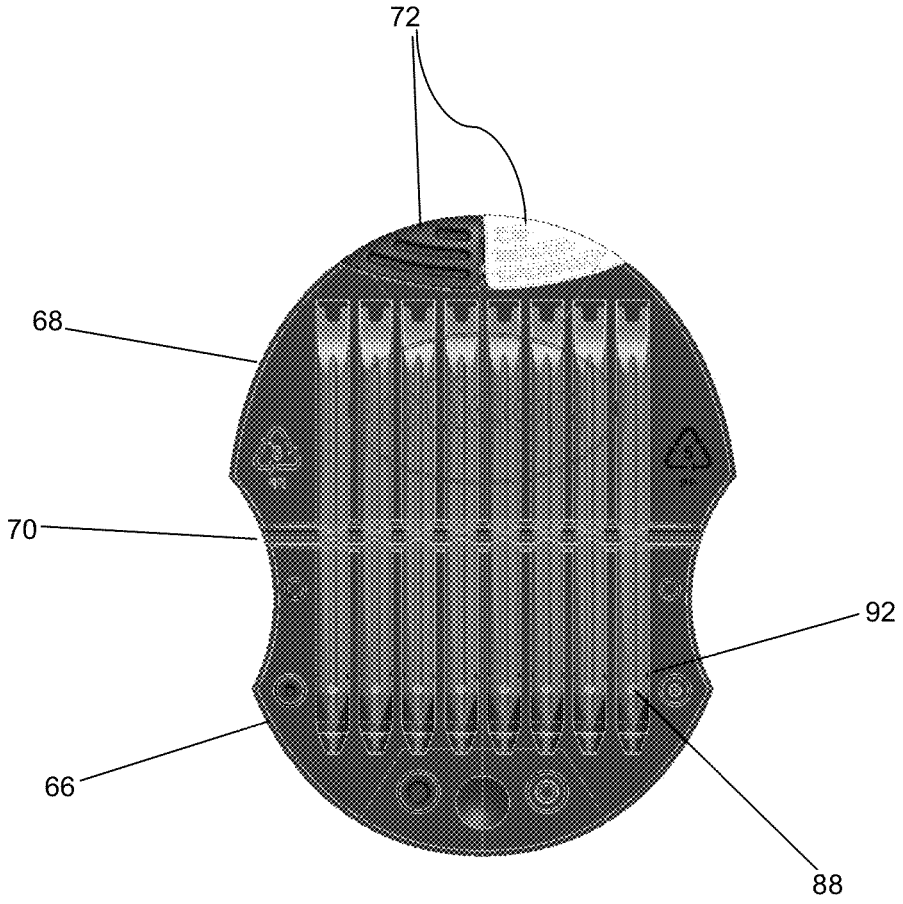
Figure 9:
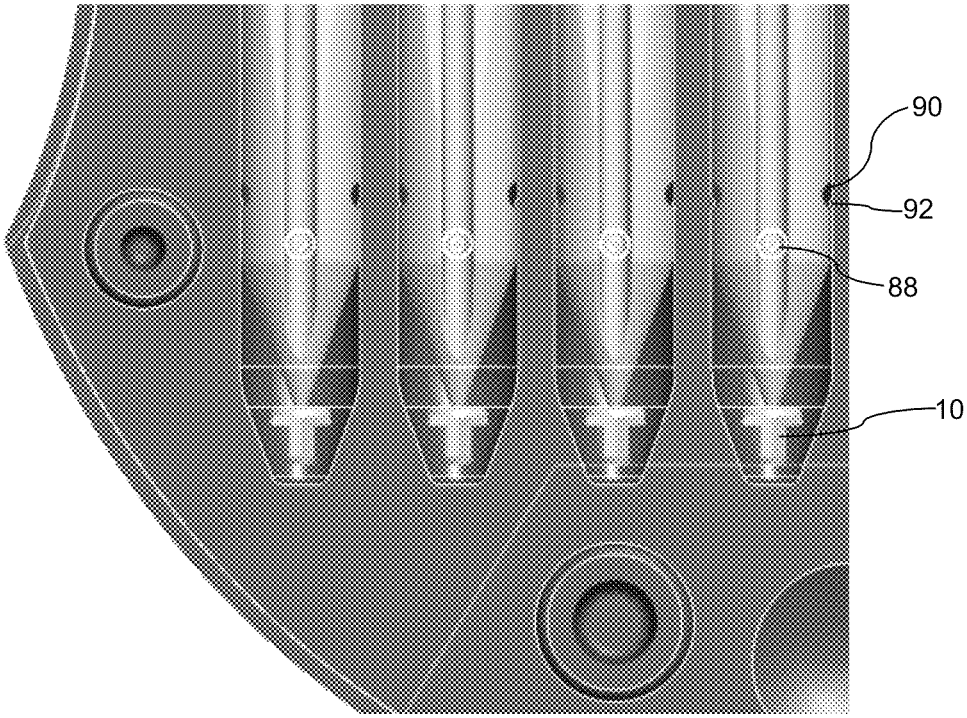

Further preferred details become apparent form the exemplary embodiment illustrated by way of the attached Figures. In the Figures, FIG. 1: shows an earwax filter according to the invention;

FIG. 2: shows the earwax filter from FIG. 1 inserted in an opening of a hearing aid component;

FIG. 3: shows a filter handling tool with attached new earwax filter;

FIG. 4: shows a dispenser pouch with a plurality of earwax filter handling tools and earwax filters inserted therein in a perspective representation;

FIGS. 5*a* and 5*b*: show a dispenser pouch from FIG. 4 fully opened in two different perspectives;

FIG. 6: is an exploded view of the dispenser pouch from FIGS. 4 and 5;

FIG. 7: is a perspective view of one shell element of the dispenser pouch from FIGS. 5 to 6;

FIG. 8: is a view of one shell element of the dispenser pouch with inside placed filter handling tools and filters;

FIG. 9: is an enlarged detail from FIG. 8; and

Figure 10:
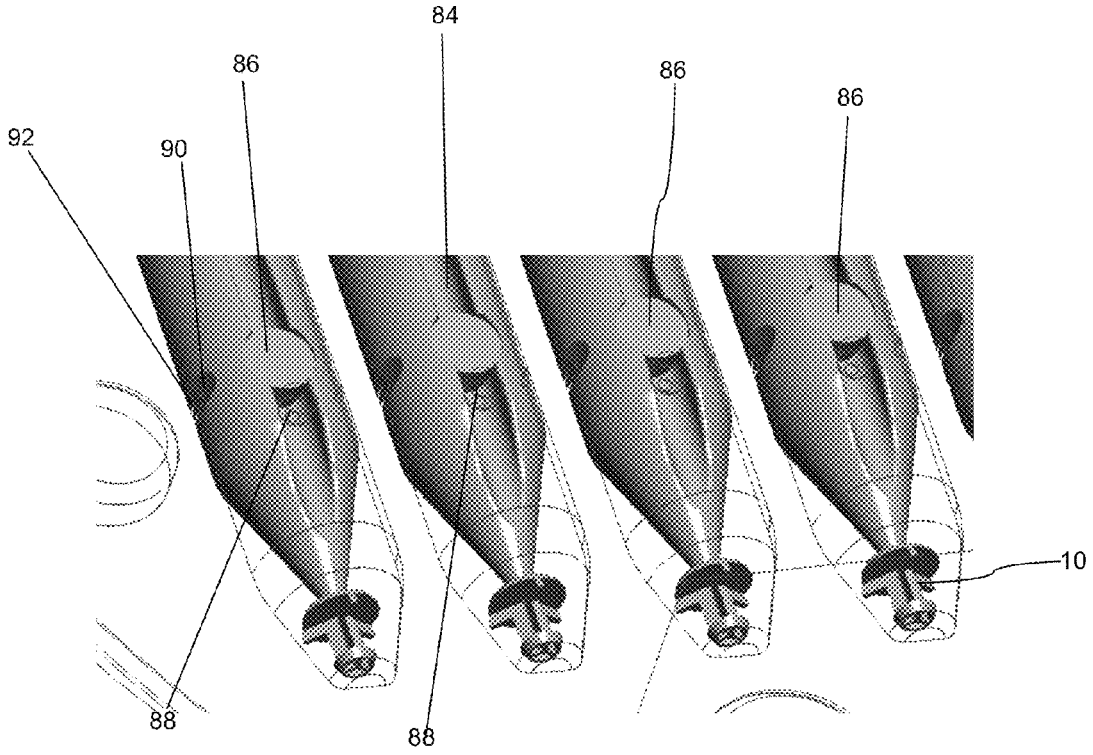

FIG. 10: is an enlarged perspective detail of distal ends of the handling tools with attached earwax filters in the skeleton view of the dispenser pouch enclosing handling tools and filters.

In FIG. 1, an earwax filter 10 according to the invention is illustrated in a perspective view. Main elements of earwax filter 10 are a top cap 12, a stem 14 and a seal 16.

The top cap 12 has an outward facing surface 20 and an inward facing surface 22. The inward facing surface 22 is facing to a hearing aid component's surface when the earwax filter 10 is inserted in an opening in such hearing aid component.

On the inward facing surface 22 of a top cap 12 three rib-shaped spacers 24 are provided. Three wall elements 26 constitute the stem 14. Each of the three wall elements 26 extends from a longitudinal axis in the center of the earwax filter 10 in a radial direction. All three wall elements 26 have the same thickness. With thickness the dimension of the wall element in a direction perpendicular to a radial direction is meant.

As can be seen, the spacers 24 extend each from a corresponding wall element 26 in the same radial and longitudinal direction. Each spacer 24 has the same thickness as the corresponding wall element 26.

Facing away from top cap 12 is a distal end of stem 14. Around the distal end of stem 14 seal 16 is arranged. Seal 16 is an annular member that is attached to all three wall elements 26. Seal 16 has a frusto-conically shaped annular side surface 28. Due to the frusto-conical shape of seal 16 a front edge of seal 16 is beveled. Further, the frusto-conical shaped side wall 28 of seal 16 provides for a sharp peripheral sealing edge 30.

As can be taken from FIG. 1, seal 16 together with wall elements 26 define three sound openings 32 that are surrounded by seal 16. The sound openings 32 communicate with the sound openings along the stem 14. Wall elements 26 and spacers 24 thus define sound openings that together with the sound openings surrounded by seal 16 each form a sound canal.

FIG. 2 is a cut-away perspective view of earwax filter 10 inserted in an opening 40 of a hearing aid component. Opening 40 of the hearing aid component is surrounded by a flexibletube 42 that is glued into a hole in a face plate 44 of hearing aid component 46. The combination of a soft tube material and the sharp peripheral sealing edge 30 ensures good sealing along the entire inner periphery of the tube surface, also if the inner surface of the tube is not perfect. Not shown is a microphone that is coupled to a far end of rubber tube 42. As can be taken from FIG. 2 spacer 24 defines a gap 48 that provides for a sound entrance to the sound canal defined by spacers 24 and wall elements 26. As further can be taken from FIG. 2, the lateral extension of top cap 12 is larger than the diameter of the opening 40 in the hearing aid component 46 as defined by rubber tube 42. The outer diameter of the sharp peripheral sealing edge 30 is matched to the inner diameter of rubber tube 42 and thus the opening in hearing aid component 46.

In FIG. 2 it can also be seen that the wall elements 26 of the stem is configured to be spaced apart from an inner wall of the opening 40 when in use. This leaves a gap 47 between the wall elements 26 and the inner surface of the tube 42 and in other words, the stem has some distance from the inner wall of the opening in the radial direction.

FIG. 3 shows an earwax filter handling tool 50 seen from two different angles, together with an earwax filter 10 that is integrally formed to filter handling tool 50. Filter handling tool 50 and earwax filter 10 are made as a single piece of plastic by injection molding. Filter handling tool 50 has a pen-shaped main body 54. Earwax filter 10 is attached to a distal end of main body 54 of filter handling tool 50 while a fork 52 is formed at a proximal end of filter handling tool 50. Fork 52 serves for removal of a used earwax filter from a hearing aid component prior to insertion of a new earwax filter. The new earwax filter will be the earwax filter 10 attached to filter handling tool 50.

When the filter 10 is inserted into the opening 40, the handling tool 50 is removed by braking the brake-away connection between the filter 10 and the handling tool 50 by gently tilting the main body 54 with respect to the filter 10 seated in the opening.

A plurality of filter handling tools 50 can be placed in a dispenser pouch 60 as shown in FIGS. 4 to 6. Dispenser pouch 60 is made from two identical injection molded plastic shells 62 as shown in the exploded view of FIG. 6. One injection molded plastic shell is shown in FIG. 7. The two shells 62 of dispenser pouch 60 are connected by means of snap fit connectors 64 in a lower part 66 of shells 62. An upper part 68 of shell 62 is integrally connected to lower part 66 of shell 62 by means of a bending hinge 70. In the disclosed embodiment the hinge 70 is molded integrally with the two parts 66, 68 of the shell 62, but other forms of hinges could be used. The bending hinge 70 allows opening the dispenser pouch 60 as shown in FIGS. 4 to 6 by grips 72. Grips 72 feature protrusions 73 and corresponding indents 76 that provide for a snap fit lock for keeping dispenser pouch 60 closed.

From FIG. 7 it can be seen, that in this particular embodiment, dispenser pouch 60 is configured to receive eight filter handling tools 50. Therefore, each shell 62 has eight grove-shaped receptacles 80. Each receptacle 80 is formed to receive a pen-shaped handling tool 50 with its distal end first. Along the longitudinal directions of receptacles 80 guiding rips 82 are provided, that interact to form the grove-shaped receptacles for handling tool 50 when the two shells 62 are connected.

FIG. 8 shows the shells 62 in a plane view, whereby the top shell is indicated in a see-through mode, so the individual handling tools 50 are visible in each their receptacle 80 side by side.

In FIG. 10 discloses how the distal end of handling tool 50 is provided with a stop 86. The stop 86 interacts with a counter stop 88 in each receptacle in the dispenser pouch and that prevents a filter handling tool 50 to be inserted too deeply in a receptacle 80. Thus enough room around earwax filter 10 is maintained when filter handling tool 50 is inserted in dispenser pouch 60; see detailed representation in FIG. 10. Thus it is prevented that earwax filter 10 is unintentionally broken off filter handling tool 50 inside dispenser pouch 60.

In addition, indents 90 on each filter handling tool 50 and protrusions 92 in each receptacle 80 define a snap lock that ensures that filter handling tool 50 will not fall out of its corresponding receptacle 80 if dispenser pouch 60 is e.g. opened upside down.

The invention claimed is:

1. Transducer protection for placement in an opening of a hearing aid component, said protection comprising:

a top cap with an outward-facing and an inward-facing side, said inward-facing side facing the hearing aid, when in use;

a stem protruding in the opening of a hearing aid component, when in use, said stem having a proximal end connected to the top cap and a distal end;

a seal connected to the stem's distal end, said seal having an outer circumferential contour that is adapted to match an inner wall of the opening and to contact said inner wall circumferentially, when in use;

at least one sound opening surrounded by the seal;

at least one spacer arranged on the inward-facing side of the top cap and formed to provide for a gap between the inward-facing side of the top cap and an outer surface of the hearing aid component, when in use; and at least one sound opening along the stem communicating with the at least one sound opening surrounded by the seal and with the gap provided by the spacer, wherein the stem is configured to be spaced apart from an inner wall of an opening of a hearing aid component, when in use.

2. Transducer protection according to claim 1, wherein the top cap has a lateral extension that is larger than an opening in an outer surface of a hearing aid component that is covered by the top cap, when the transducer protection is in use.

3. Transducer protection according to claim 1, wherein the gap provided by the spacer, the sound opening along the stem and the sound opening surrounded by the seal form a sound canal along the transducer protection.

4. Transducer protection according to claim 1, wherein the stem is formed by at least one wall element extending along a longitudinal axis of the transducer protection and wherein the sound opening along the stem is delimited by the wall.

5. Transducer protection according to claim 4, wherein the sound opening along the stem is radially open to the outside of the transducer protection.

6. Transducer protection according to claim 1, wherein the seal has an outer circumferential edge designed to abut an inner wall of an opening in a hearing aid component.

7. Transducer protection according to claim 1, wherein the stem has wall elements, each wall element extending from a longitudinal central axis of the transducer protection in a different radial direction than the other wall elements.

8. Transducer protection according to claim 7, wherein wall elements are provided to meet at equally large angles in the centre of the transducer protection.

9. Transducer protection according to claim 4, wherein the spacers are provided to be rib-shaped and to extend in the same radial and longitudinal direction as a corresponding wall element of the stem.

10. Transducer protection according to claim 7, wherein the wall elements of the stem are supporting the seal.

11. Transducer protection according to claim 1, wherein the seal has an annular shape with a frusto-conical shaped side surface that defines a beveled front edge of the seal as well as a sealing edge on its outer periphery.

12. Transducer protection handling tool with pen-shaped main body having a first longitudinal end formed as a fork for removing a transducer protection and a second, opposite, longitudinal end with a transducer protection according to claim 1 integrally molded with the main body.

13. A transducer protection handling tool, comprising:

a pen-shaped main body having a first longitudinal end formed as a fork for removing a transducer protection; and a second, opposite, longitudinal end with a transducer protection integrally molded with the main body, the transducer protection including a top cap with an outward-facing and an inward-facing side, said inward-facing side facing the hearing aid, when in use;

a stem protruding in the opening of a hearing aid component, when in use, said stem having a proximal end connected to the top cap and a distal end;

a seal connected to the stem's distal end, said seal having an outer circumferential contour that is adapted to match an inner wall of the opening and to contact said inner wall circumferentially, when in use;

at least one sound opening surrounded by the seal;

at least one spacer arranged on the inward-facing side of the top cap and formed to provide for a gap between the inward-facing side of the top cap and an outer surface of the hearing aid component, when in use; and at least one sound opening along the stem communicating with the at least one sound opening surrounded by the seal and with the gap provided by the spacer, wherein the main body exhibits at least one grove along its longitudinal direction for guiding the handling tool during insertion into or removal from a dispenser pouch.

14. A transducer protection handling tool comprising:

a pen-shaped main body having a first longitudinal end formed as a fork for removing a transducer protection; and a second, opposite, longitudinal end with a transducer protection integrally molded with the main body, the transducer protection including a top cap with an outward-facing and an inward-facing side, said inward-facing side facing the hearing aid, when in use;

a stem protruding in the opening of a hearing aid component, when in use, said stem having a proximal end connected to the top cap and a distal end;

a seal connected to the stem's distal end, said seal having an outer circumferential contour that is adapted to match an inner wall of the opening and to contact said inner wall circumferentially, when in use;

at least one sound opening surrounded by the seal;

at least one spacer arranged on the inward-facing side of the top cap and formed to provide for a gap between the inward-facing side of the top cap and an outer surface of the hearing aid component, when in use; and at least one sound opening along the stem communicating with the at least one sound opening surrounded by the seal and with the gap provided by the spacer, wherein the main body has a stop configured to interact with a counter stop in a dispenser pouch and preventing too deep an insertion of the main body into a dispenser pouch.

15. The transducer protection handling tool according to claim 14, wherein the stop is configured to be effective when the main body is inserted with the transducer protection first into a dispenser pouch.

16. Transducer protection according to claim 2, wherein the gap provided by the spacer, the sound opening along the stem and the sound opening surrounded by the seal form a sound canal along the transducer protection.

17. Transducer protection according to claim 2, wherein the stem is formed by at least one wall element extending along a longitudinal axis of the transducer protection and wherein the sound opening along the stem is delimited by the wall.

18. Transducer protection according to claim 3, wherein the stem is formed by at least one wall element extending along a longitudinal axis of the transducer protection and wherein the sound opening along the stem is delimited by the wall.

19. Transducer protection according to claim 2, wherein the seal has an outer circumferential edge designed to abut an inner wall of an opening in a hearing aid component.

* * * * *